US008960065B2

(12) United States Patent
Masson et al.

(10) Patent No.: US 8,960,065 B2
(45) Date of Patent: Feb. 24, 2015

(54) METHOD FOR BRAIDING REINFORCING FIBERS WITH VARIATION IN THE INCLINATION OF THE BRAIDED FIBERS

(75) Inventors: Richard Masson, Les Loges en Josas (FR); Bertrand Desjoyeaux, Sainte Adresse (FR); Romain Boudier, Versailles (FR)

(73) Assignees: Messier-Bugatti-Dowty, Velizy-Villacoublay (FR); Aircelle, Gonfreville l'Orcher (FR)

( * ) Notice: Subject to any disclaimer, the term of this patent is extended or adjusted under 35 U.S.C. 154(b) by 0 days.

(21) Appl. No.: 13/996,370

(22) PCT Filed: Dec. 21, 2011

(86) PCT No.: PCT/EP2011/073692

§ 371 (c)(1), (2), (4) Date: Aug. 1, 2013

(87) PCT Pub. No.: WO2012/085156

PCT Pub. Date: Jun. 28, 2012

(65) Prior Publication Data

US 2013/0305911 A1 Nov. 21, 2013

(30) Foreign Application Priority Data

Dec. 24, 2010 (FR) ..... 10 61259

(51) Int. Cl.

| | |
|---|---|
| ***D04C 3/48*** | (2006.01) |
| ***D04C 1/06*** | (2006.01) |
| ***D04C 3/34*** | (2006.01) |

(52) U.S. Cl.

CPC .. *D04C 1/06* (2013.01); *D04C 3/48* (2013.01); *D04C 3/34* (2013.01); *D10B 2505/02* (2013.01)

USPC ..... 87/34; 87/41

(58) Field of Classification Search

USPC ..... 87/34, 41, 62

See application file for complete search history.

(56) References Cited

U.S. PATENT DOCUMENTS

| | | | | |
|---|---|---|---|---|
| 4,785,709 | A | 11/1988 | Freitas | |
| 5,203,249 | A * | 4/1993 | Adams et al. | 87/34 |
| 5,388,497 | A * | 2/1995 | Akiyama et al. | 87/34 |
| 5,398,586 | A * | 3/1995 | Akiyama et al. | 87/6 |
| 5,979,288 | A * | 11/1999 | Gallagher et al. | 87/36 |
| 6,024,005 | A * | 2/2000 | Uozumi | 87/34 |
| 6,495,227 | B1 * | 12/2002 | Cahuzac | 428/36.3 |
| 6,616,996 | B1 | 9/2003 | Keith et al. | |

(Continued)

FOREIGN PATENT DOCUMENTS

EP 0 307 112 A2 3/1989

*Primary Examiner* — Shaun R Hurley

(74) *Attorney, Agent, or Firm* — Sughrue Mion, PLLC

(57) ABSTRACT

A method of braiding reinforcing fibers on a mandrel (8) with a machine having a ring (9) carrying at least two series of reels of fibers, by moving the mandrel at a predetermined forward speed while moving the two series of reels along the ring (9) so that they cross while rotating in opposite directions and at a predetermined speed of rotation about an axis (AX) of the ring. The braid is formed on the mandrel (8) in the vicinity of a region of convergence (R) of the fibers that together define a conical shape (C). The method comprises: a step of reconfiguring the machine in which the angle (a2) at the apex of the cone (C) defined by the fibers takes on a new value (a2); and a step of restarting braiding in which the movement of the reels along the ring (9) and the forward movement of the mandrel (8) are re-established with a new speed of rotation and a new speed of advance.

6 Claims, 4 Drawing Sheets

(56) References Cited

U.S. PATENT DOCUMENTS

| | | | | |
|---|---|---|---|---|
| 7,444,916 | B2 * | 11/2008 | Hirukawa | 87/34 |
| 7,793,576 | B2 * | 9/2010 | Head et al. | 87/34 |
| 8,006,601 | B2 * | 8/2011 | Inazawa et al. | 87/1 |
| 2010/0052203 | A1 * | 3/2010 | Inazawa et al. | 264/103 |
| 2010/0083815 | A1 * | 4/2010 | Inazawa et al. | 87/1 |
| 2010/0252182 | A1 * | 10/2010 | Rettig | 156/189 |

* cited by examiner

METHOD FOR BRAIDING REINFORCING FIBERS WITH VARIATION IN THE INCLINATION OF THE BRAIDED FIBERS

This is a National Stage Entry of Application No. PCT/EP2011/073692 filed Dec. 21, 2011, claiming priority based on French Patent Application No. 1061259 filed Dec. 24, 2010, the contents of all of which are incorporated herein by reference in their entirety.

The invention relates to fabricating parts out of composite material, which parts are obtained by applying one or more layers of braided reinforcing fibers on a mandrel.

BACKGROUND OF THE INVENTION

In such a method, which is used in example for fabricating a connecting rod out of composite material, a mandrel is used that mainly constitutes a support on which the layers of braided reinforcing fibers are formed. The braided layers fit closely to the outside shape of the mandrel when they are applied thereon, such that the final connecting rod has a shape that corresponds to a desired shape.

The layers of reinforcing fibers are applied on the mandrel with a braiding machine of the same type as the machine referenced 1 in FIG. 1.

The mandrel 2 is then installed in the machine 1, which essentially comprises a ring 3 carrying two series of reels of reinforcing fibers. The reinforcing fibers 4 meet on the mandrel that extends along an axis AX, in a region of convergence situated at a certain distance from the ring 3, so that the reinforcing fibers together define a conical shape.

The launching of a braiding cycle causes firstly the mandrel 2 to be moved relative to the ring 3 along the axis AX, and secondly the reels of the first series and the reels of the second series to be moved along the circumference of the ring in opposite directions.

The reels of the first series follow a first sinusoidal path extending along the circumference of the ring, and the reels of the second series follow a second sinusoidal path also extending along the circumference of the ring, and crossing the first path.

In practice, the reels of the first series and the reels of the second series alternate along the circumference of the ring. In operation, the reels of the first series and the reels of the second series turn in opposite directions while following their sinusoidal paths, so that they cross without interfering with one another in order to form the braid.

The angle of inclination θ of the fibers in the layer of braided fibers relative to the longitudinal axis AX, is thus determined by the forward speed Vm of the mandrel along the axis AX and by the speed of rotation ωc of the reels around the axis AX, and also by the diameter Dm of the mandrel, in accordance with the following relationship:

$$\tan(\theta)=\pi\cdot Dm\cdot\omega c/Vm$$

For a given part, the forward speed of the mandrel and the speed of rotation of the reels are adjusted so that the fibers are braided while being inclined at a predetermined angle θ such as 30° or 60° relative to the axis AX. Several passes may be performed in order to build up a plurality of superposed layers of braided fibers around the mandrel.

The assembly constituted by the mandrel and the various layers of braided fibers that it carries is then placed in a mold. Resin is then injected in order to impregnate the layers of fibers, after which the resin is polymerized, e.g. by heating, so that the assembly constituted by the layers of fibers and the resin constitutes a rigid whole.

That method makes it possible to fabricate a connecting rod having mechanical qualities that are substantially identical in its various regions. However, that method is not suitable for acting in a competitive manner to produce connecting rods such as the connecting rods 6 and 7 shown in FIGS. 2 and 3, since their looked-for mechanical qualities are different depending on whether consideration is given to their ends or else to their main bodies.

Specifically, the ends comprise lugs that constitute force-insertion zones, and they are consequently subjected to multidirectional mechanical stresses that are very different from and much higher than the stresses to which the body of the connecting rod is subjected, which mechanical stresses are mainly longitudinal.

In practice, it is necessary to add material at the ends in order to increase the mechanical strength and the fatigue behavior in those regions. Nevertheless, such existing solutions for adding material locally are complex and very expensive to perform.

OBJECT OF THE INVENTION

The object of the invention is to propose a solution for remedying that drawback.

SUMMARY OF THE INVENTION

To this end, the invention provides a method of braiding a layer of reinforcing fibers on a mandrel using a braiding machine having a ring carrying at least two series of reinforcing fiber reels:

- by moving the mandrel longitudinally along a direction normal to the ring at a predetermined forward speed; and
- by moving the two series of reels along the ring so that they cross while rotating at a predetermined speed of rotation in opposite directions about a central axis of the ring;
- the braid being formed on the mandrel in a region of convergence of the reinforcing fibers in the vicinity of which the reinforcing fibers together define a conical shape;

the method being characterized in that it comprises:

- a reconfiguration step in which the movement of the reels is stopped, and in which the machine is rearranged so that the angle at the apex of the cone that is defined by the reinforcing fibers in the vicinity of the region of convergence takes on a new value, and in which the machine is set with a new forward speed for the mandrel and a new speed of rotation for the reels; and
- a step of restarting the braiding, in which the movement of the reels along the ring and of the advance of the mandrel are re-established using the new forward speed and the new speed of rotation.

The fact of reconfiguring the machine during a braiding operation by modifying the cone angle formed by the fibers and also by modifying the forward speed of the mandrel and the speed of rotation of the reels, makes it possible to produce a braid having different regions that correspond to different angles of inclination for the fibers.

The braid thus presents mechanical qualities that differ from one region to another, thereby making it possible, at low cost, to produce connecting rods having mechanical characteristics that differ from one region to another.

The invention also provides a method as defined above, wherein the rearrangement of the machine in order to modify the angle of the cone defined by the reinforcing fibers is performed by moving the mandrel towards or away from the ring in order to reduce or increase the distance between the ring and the region of convergence of the fibers.

The invention also provides a method as defined above, wherein the rearrangement of the machine in order to modify the angle of the cone defined by the reinforcing fibers is performed by an additional ring of smaller diameter than the diameter of the ring carrying reels, and by moving this additional ring towards or away from the mandrel in order to increase or reduce the distance between the additional ring and the region of convergence of the fibers.

The invention also provides a method as defined above, wherein the reels of reinforcing fibers carried by the ring are reeled in when the region convergence is moved towards the ring.

The invention also provides a method as defined above, wherein the new value of the angle of the cone corresponds to the value of the angle that the cone would take during a stabilized normal braiding cycle in which the mandrel advances with the new forward speed and in which the reels rotate at the new speed of rotation.

The invention also provides a method as defined above, including, prior to the step of rearranging the machine so that the angle at the apex of the cone that is defined by the reinforcing fibers in the vicinity of the region of convergence takes on a new value, a step of putting into place means that surround of the fibers on the mandrel in the vicinity of the region of convergence in order to hold the fibers during the rearrangement.

DETAILED DESCRIPTION OF THE INVENTION

The idea on which the invention is based is to modify the angle of inclination of the fibers relative to the longitudinal axis during a braiding operation by stopping the machine in order to reconfigure it with new settings for the speed of advance of the mandrel and for the speed of rotation of the reels, while also modifying the angle of the cone that is formed by the reinforcing fibers in the vicinity of the region of convergence of the fibers on the mandrel.

In a first implementation of the invention, the cone angle formed by the reinforcing fibers is modified by changing the distance between the mandrel and the ring along the axis AX. In the second implementation of the invention, the cone angle formed by the reinforcing fibers is modified by a vibrating ring placed inside the cone, and by changing the distance between the ring and the region of convergence.

Figure 4A:
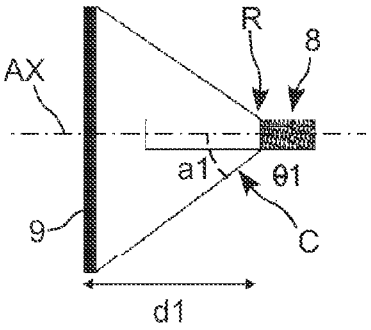
FIGS. 4A to 4C are diagrammatic side views showing a step of reducing the angle of inclination of the fibers in a first implementation of the invention.
Figure 5A:
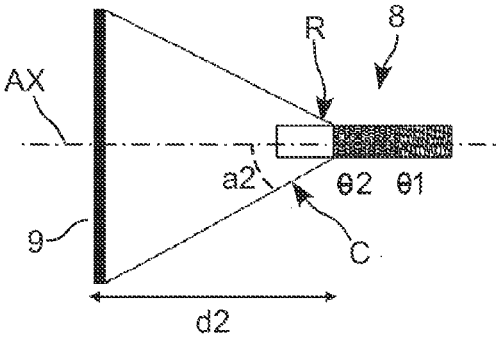
FIGS. 5A to 5C are diagrammatic side views showing a step of increasing the angle of inclination of the fibers in the first implementation of the invention.
Figure 4B:
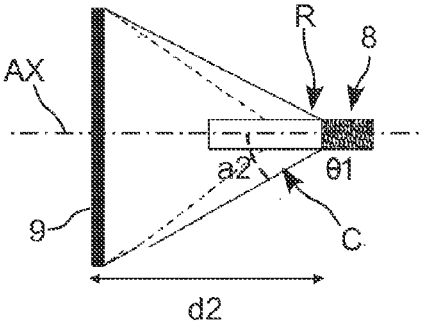
Figure 5B:
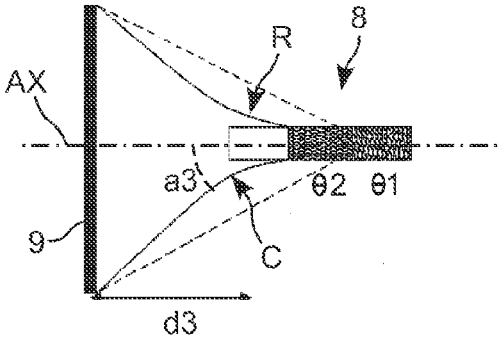
Figure 4C:
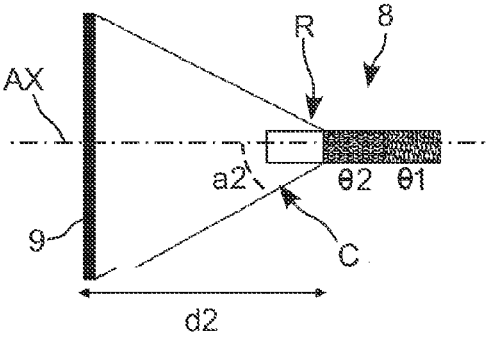

In FIGS. 4A to 4C, the mandrel 8 is moved longitudinally along an axis AX in a braiding machine that mainly comprises a ring 9 carrying two series of reels of reinforcing fibers (not shown), the ring 9 extending in a plane normal to the axis AX.

In the configuration of FIG. 4A, the mandrel 8 is moved along the axis AX at a first forward speed value Vm1, and the two series of reels are moved along the ring 9 while turning in opposite directions about the axis AX at a predetermined first speed of rotation ωc1.

The reels of the first and second series are moved respectively to rotate in opposite directions along two crossing sinusoidal paths along the circumference of the ring in such a manner as to form the braid of reinforcing fibers.

With the braiding machine having the following settings (Vm1, ωc1), the ring on 9 is naturally spaced apart by a distance d1 from the region R where the reinforcing fibers converge on the mandrel 8.

Under these conditions, the braid of reinforcing fibers that is formed on the mandrel 8 is constituted by fibers that are all inclined relative to the axis AX by a predetermined angle that is written θ1.

Specifically, the forward speed Vm1 of the mandrel 8 along the axis AX and the speed of rotation ωc1 of the reels about the axis AX are determined from the desired angle of inclination θ1 in accordance with the following relationship, in which Dm designates the diameter of the mandrel 8 for the braiding zone under consideration:

$$\tan(\theta 1)=\pi\cdot Dm\cdot\omega c/Vm1$$

In order to reduce the angle of inclination of the fibers relative to the axis AX, a step of reconfiguring the braiding machine is performed. The rotation of the reels about the axis AX is initially stopped, and then the mandrel 8 is moved along the axis AX in order to move it away from the ring 9, so that the region of convergence R of the fibers is spaced apart from the ring by a new distance d2. During this step, the reinforcing fibers are unreeled from the reels so as to allow the mandrel 8 to move away from the ring 9.

The distance d2 is advantageously determined beforehand, e.g. empirically or experimentally. It corresponds to the distance at which the ring 9 is naturally spaced apart from the region of convergence R when the machine is set so that the braiding fibers have a new angle of inclination θ2 relative to the axis AX. As can readily be understood, the settings that make it possible to obtain a desired angle of inclination θ2 (θ2<θ1) comprise a new forward speed Vm2 and a new speed of rotation ωc2 for the reels, which speeds are determined using the relationship given above.

Once the mandrel has been placed at the distance d2 from the ring 9, the machine is set for its new forward speed and its new speed of rotation of the reels (Vm2, ωc2). It is then activated in order to cause the mandrel 8 to advance and the reels to rotate about the axis AX using these new settings. This causes a new portion of braid to be formed in which the fibers are inclined with the angle θ2 relative to the axis AX, with this being shown diagrammatically in FIG. 4C.

An increase in the angle of inclination of the reinforcing fibers relative to the axis AX is obtained in analogous manner by stopping the machine in order to reconfigure it. The rotation of the two series of reels around the axis AX is then stopped, and the mandrel is held stationary along the axis AX. The mandrel 8 is then moved along the axis AX, but this time so as to bring it closer to the ring 9, and at the same time the reinforcing fibers are returned into the machine in order to enable the mandrel 8 to approach without slackening the reinforcing fibers.

In practice, the fibers are returned either by being reeled in, or else by using any other device for taking up excess length, where such a device may be associated with each fiber outlet, or may be an overall appliance fitted to the machine.

The mandrel is thus placed in such a manner that the region of convergence R of the fibers is spaced apart from the ring 9 by a new distance d3. The new distance d3 is determined beforehand, e.g. empirically, so as to correspond to the distance that would naturally be taken up by the region of convergence R when the machine is set with values Vm3 and ωc3 corresponding to the looked-for new value θ3 for the angle of inclination of the fibers relative to the axis AX. As shown in figures, increasing the angle of inclination of the fibers (θ3>θ2) leads to a distance d3 that is less than the distance d2.

Once the mandrel has been placed in its new position and the machine has been configured with the new settings Vm3 and ωc3, the machine is activated to move the mandrel and to cause the reinforcing fiber reels to turn in application of the new settings.

Figure 5C:
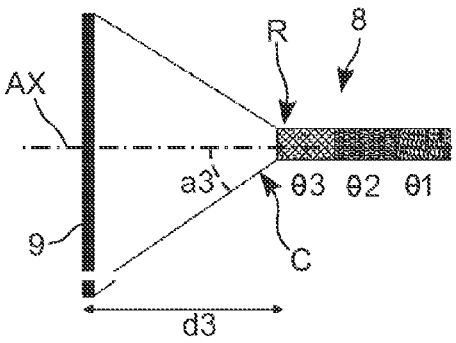

This causes a new portion of braid to be braided in which the fibers are inclined at the angle θ3 relative to the axis AX, as shown diagrammatically in FIG. 5C.

As can be seen in FIGS. 4A to 5C, modifying the distance between the ring 9 and the region of convergence R of the fibers makes it possible to modify the angle of the cone C formed by the reinforcing fibers in the vicinity of the region of convergence R. This angle thus takes on values a1, a2, and a3 when the distance between the ring 9 and of the region R is equal respectively to d1, d2, and d3.

In the second implementation of the invention, the angle of the cone C is modified, not by acting on the distance between the ring 9 and the region of convergence R, but by using a vibrating ring that is placed inside the cone defined by the reinforcing fibers.

Such a vibrating ring is referenced 11 in FIGS. 6A to 7C and it presents a nominal diameter that is less than the inside diameter of the ring 9, being placed on the same axis as the ring 9 and being spaced apart therefrom along the axis AX. The ring 11 advantageously vibrates in such a manner as to reduce the friction of the fibers sliding over it. However the ring could also be a non-vibrating ring, in the event that it generates low levels of friction.

Figure 6A:
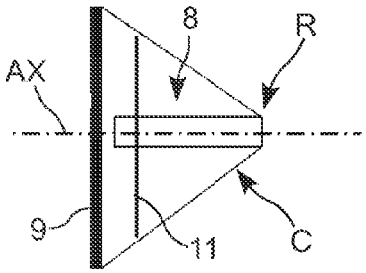
FIGS. 6A to 6C are diagrammatic side views showing a step of reducing the angle of inclination of the fibers in a second implementation of the invention.
Figure 7A:
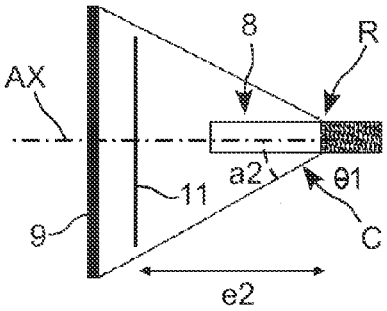
FIGS. 7A to 7C are diagrammatic side views showing a step of increasing the angle of inclination of the fibers in a second implementation of the invention.

Thus, starting from the situation in FIG. 6A in which the reinforcing fibers define a single cone going from the periphery of the ring 9 and having its apex in the vicinity of the region of convergence R of the fibers on the mandrel 8, the ring 9 is moved towards the region of convergence R.

Figure 6B:
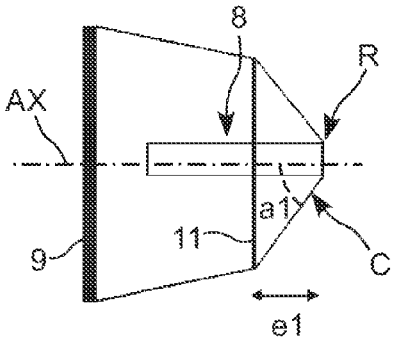
Figure 7B:
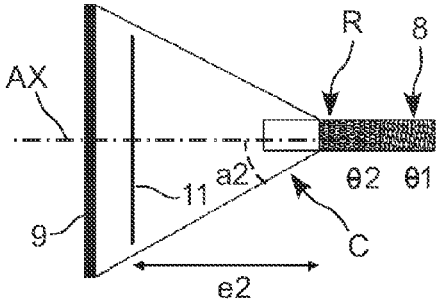

As shown in FIG. 6B, the ring 11 is placed at a distance e1 from the region of convergence R, where this distance e1 is such that the angle of the cone C formed by the reinforcing fibers in the vicinity of the region of convergence R corresponds to a predetermined value, written a1.

During this operation, the reels carried by the ring 9 revolve so as to reel out fiber in order to allow the vibrating ring 11 to move along the axis AX.

The value a1 of the cone angle is determined beforehand, e.g. empirically. It corresponds to the angle that is naturally taken up by the cone defined by the reinforcing fibers when the braiding machine is operating normally with settings for producing a braid in which the fibers are inclined relative to the axis AX by a target value written θ1.

As can be understood, the settings of the machine in order to obtain the angle of inclination θ1 are the forward speed Vm1 of the mandrel 8 and the speed of rotation ωc1 of the reels about the axis AX, which speeds are determined in accordance with the relationship given above.

Figure 6C:
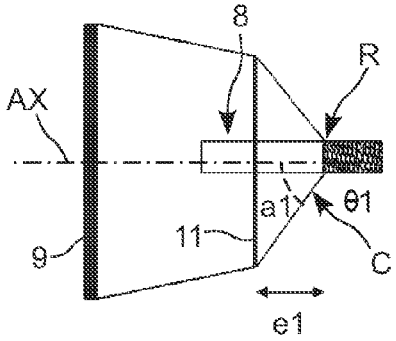

Once the ring 11 is in place and the machine has been configured with the settings Vm1 and ωc1, the braiding cycle is activated, thereby causing a first portion of braid to be formed in which the reinforcing fibers are inclined at an angle θ1 relative to the axis AX, as shown in FIG. 6C.

When this first portion has been terminated, a reduction in the angle of inclination of the fibers relative to the axis AX in the braid that is being formed is obtained by stopping the machine in order to reconfigure it. The vibrating ring 11 is then moved along the axis AX away from the region of convergence R, as shown diagrammatically in FIG. 7A, so as to reduce the angle of the cone C.

In this example, the vibrating ring 11 is merely moved away from the region of convergence R so as to be placed at a distance e2 from the region of convergence R, corresponding to a position in which it is no longer in contact with the fibers. However it could be moved through a shorter distance and remain in contact with the reinforcing fibers.

While the vibrating ring is being moved, the reels carried by the ring may be reeled-in so as to keep the reinforcing fibers under sufficient tension. In this implementation of the invention, as in the first implementation, the reels may advantageously be fitted with independent motors enabling them to reel in during each reconfiguration of the machine that requires reeling in.

At this stage, the reinforcing fibers constitute a cone having an angle at the apex with a new value, written a2, that corresponds to the value that would naturally be taken by this cone angle when the machine is set to form a braid in which the fibers are inclined relative to the axis AX by a new target angle value, written θ2 (θ2<θ1).

As can be understood, the settings of the machine for obtaining a target angle of inclination of θ2 are a forward speed for the mandrel Vm2 and a speed of rotation ωc2 for the reels about the axis AX that are determined from the relationship given above.

Once the ring has been placed at the distance e2 from the region R, the machine is set to the new values for forward speed Vm2 and for speed of rotation ωc2 prior to being activated, thereby causing a new segment of a braid to be formed in which the fibers are inclined relative to the axis AX by a new angle θ2.

When the second segment has been braided, the machine is stopped in order to be reconfigured so as to form a third segment in which the angle of inclination of the fibers relative to the axis AX is greater than that of the second segment.

The vibrating ring is then moved towards the region of convergence R in such a manner as to be spaced apart therefrom by a distance written e3, such that the cone angle formed by the reinforcing fibers in the vicinity of the region R takes on a new value written a3.

This new value a3 for the angle of the cone C is determined beforehand, e.g. empirically: it corresponds to the angle value that would be taken on by the cone C when the machine is set to form a braid in which the fibers are inclined relative to the axis AX at an angle written θ3 (θ3>θ2).

As in the preceding circumstances, the parameters enabling a braid to be formed having fibers that are inclined at an angle of θ3 relative to the axis AX are a new value for the forward speed of the mandrel Vm3 and a new value for the speed of rotation ωc3 of the reels around the axis AX, as determined using the relationship given above.

Figure 7C:
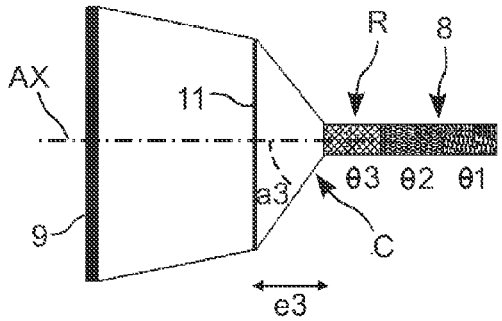

Once the ring has been placed at the distance e3 from the region R, and the new settings have been applied to the machine, the machine is activated once more in order to make a third segment of braid, as shown diagrammatically in FIG. 7C.

Figure 8:
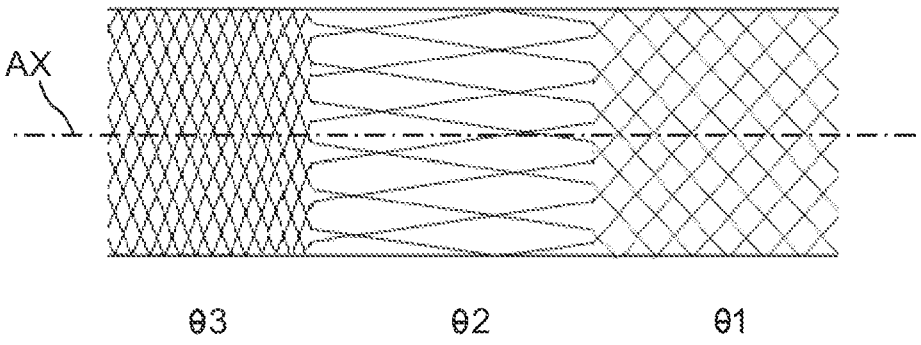
FIG. 8 is a diagrammatic side view showing the variations in the angles of inclination of the fibers that can be obtained by implementing the method of the invention.

In general, the invention makes it possible to modify the angle of inclination of the fibers over distances that are very short within a single braid of reinforcing fibers. As shown in FIG. 8, the method of the invention makes it possible in a single braid to have a plurality of consecutive segments that correspond to different angles of inclination for the reinforcing fibers.

The methods described with reference either to FIGS. 4A to 5C or with reference to FIGS. 6A to 7C can advantageously be combined. It is thus possible to make use simultaneously of an additional ring, e.g. a vibrating ring, while also moving the mandrel relative to the main ring while reeling out and/or returning the fibers.

As shown diagrammatically in FIG. 8, the transition zones from one segment to another are very short, or even practically immediate. When reconfiguring the machine in accordance with the invention, by varying not only the operating settings of the machine but also the angle of the cone defined by the reinforcing fibers, it is possible to control the length of the transition zones.

When the angle of the cone C is reconfigured so as to take on immediately a value corresponding to the new settings for forward speed and for speed of rotation, as explained above, the transition zone has a length that is practically zero. It is also possible to modify the angle of the cone C so as to give it a value that is significantly different from the values that would correspond to the new forward speed and speed of rotation values, thereby giving rise to a transition zone of greater length.

In order to further improve the accuracy of the position of the point at which the angle of inclination of the fibers changes, it is possible to bind the fibers in the region of the change of angle of inclination.

This can be done by winding a fiber tightly and circumferentially around the braiding that has already been performed, or else by using a yarn that is wound circumferentially and then heat sealed. This can also be done by winding and heat sealing gauze locally, or indeed by a combination of these various possibilities.

In practice, by modifying the angle of inclination of the fibers locally, the method of the invention makes it possible to vary the density of the fibers along the mandrel, where fiber density increases with increasing angle of inclination relative to the axis AX. It is thus possible to fabricate connecting rods such as those shown in FIGS. 2 and 3 by increasing the angle of inclination of the fibers in the regions where the cross sections of the connecting rods increase.

Figure 1:
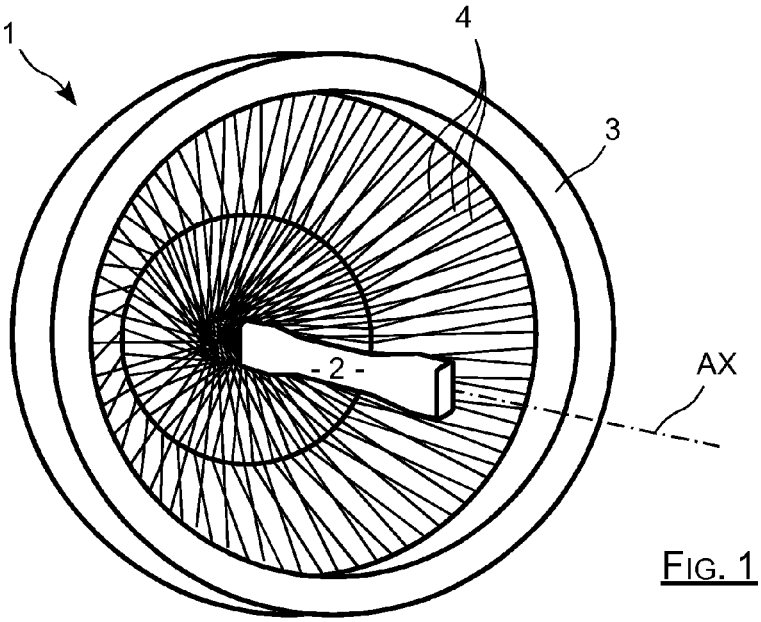
FIG. 1, described above, is a diagrammatic overall view of a braiding machine.
Figure 2:
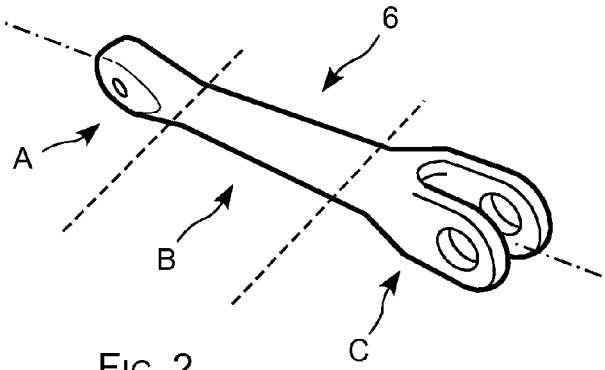
FIG. 2, described above, is a diagram showing a first connecting rod presenting a cross-section that varies significantly along its longitudinal axis.
Figure 3:
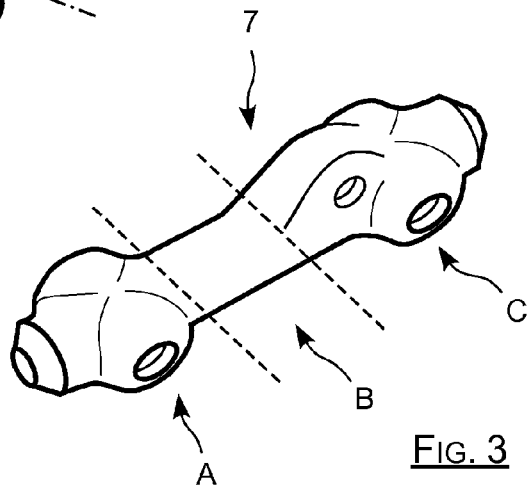
FIG. 3, described above, is a diagram showing a second connecting rod presenting a cross-section that varies significantly along its longitudinal axis.

Typically, with the connecting rods shown in FIGS. 2 and 3, the angle of inclination is greater in the vicinity of their ends, i.e. in the vicinity of the zones A and C, where the connecting rods present cross-sections that are large. These ends include lugs into which forces are introduced and they are therefore subjected to high levels of mechanical stress, thus making it necessary for them to have a greater quantity of reinforcing fibers.

In contrast, the angle of inclination of the fibers is smaller in the bodies of the connecting rods, i.e. regions corresponding to the zones referenced B in FIGS. 2 and 3, since the mechanical stresses in those regions are not only smaller, but they are also distributed in a manner that is much more uniform.

By way of example, the angle of inclination of the fibers relative to the axis AX at the ends A and C may be equal to 60°, for example, whereas it need be no more than 30° in the central regions B corresponding to the bodies of the connecting rods.

The invention claimed is:

1. A method of braiding a layer of reinforcing fibers on a mandrel (8) using a braiding machine having a ring (9) carrying at least two series of reinforcing fiber reels comprising:

moving the mandrel longitudinally, along a direction (AX) normal to and defining a central axis of the ring (9), at a predetermined forward speed (Vm1, Vm2, Vm3); and moving the at least two series of reels along the ring (9) so that they cross while rotating at a predetermined speed of rotation (ωc1, ωc2, ωc3) in opposite directions about the central axis (AX) of the ring;

wherein the braid is formed on the mandrel (8) in a region of convergence (R) of the reinforcing fibers in a vicinity of which the reinforcing fibers together define a conical shape (C);

the method further comprising:

a reconfiguration step in which the movement of the reels is stopped, and in which the machine is rearranged so that an angle (a1, a2, a3) at the apex of the conical shape (C) that is defined by the reinforcing fibers in the vicinity of the region of convergence (R) takes on a new value (a1, a2, a3), and in which the machine is set with a new forward speed (Vm1, Vm2, Vm3) for the mandrel (8) and a new speed of rotation (ωc1, ωc2, ωc3) for the reels; and a step of restarting the braiding, in which the movement of the reels along the ring (9) and of the advance of the mandrel (8) are re-established using the new forward speed (Vm1, Vm2, Vm3) and the new speed of rotation (ωc1, ωc2, ωc3).

2. The method according to claim 1, wherein the rearrangement of the machine in order to modify the angle (a1, a2, a3) of the conical shape (C) defined by the reinforcing fibers is performed by moving the mandrel (8) towards or away from the ring (9) in order to reduce or increase a distance (d1, d2, d3) between the ring (8) and the region of convergence (R) of the fibers.

3. The method according to claim 1, wherein the rearrangement of the machine in order to modify the angle (a1, a2, a3) of the conical shape (C) defined by the reinforcing fibers is performed by an additional ring (11) of smaller diameter than the diameter of the ring (9) carrying reels, and by moving said additional ring (11) towards or away from the mandrel (8) in order to increase or reduce a distance (e1, e2, e3) between the additional ring (11) and the region of convergence (R) of the fibers.

4. The method according to claim 1, wherein the reels of reinforcing fibers carried by the ring (9) are reeled in when the region of convergence (R) is moved towards the ring (9; 11).

5. The method according to claim 1, wherein the new value of the angle (a1, a2, a3) of the conical shape (C) corresponds to the value of the angle that the conical shape (C) would take during a stabilized normal braiding cycle in which the mandrel (8) advances with the new forward speed (Vm1, Vm2, Vm3) and in which the reels rotate at the new speed of rotation (ωc1, ωc2, ωc3).

6. The method according to claim 1, including, prior to the step of rearranging the machine so that the angle (a1, a2, a3) at the apex of the conical shape (C) that is defined by the reinforcing fibers in the vicinity of the region of convergence (R) takes on a new value (a1, a2, a3), a step of putting into place means that surround the fibers on the mandrel in the vicinity of the region of convergence (R) in order to hold the fibers during the rearrangement.

* * * * *